US006747220B2

(12) United States Patent
Marine

(10) Patent No.: US 6,747,220 B2
(45) Date of Patent: Jun. 8, 2004

(54) POSITION/MOTION SENSOR

(75) Inventor: Jon C. Marine, Fullerton, CA (US)

(73) Assignee: Mattel, Inc., El Segundo, CA (US)

( * ) Notice: Subject to any disclaimer, the term of this patent is extended or adjusted under 35 U.S.C. 154(b) by 157 days.

(21) Appl. No.: 09/934,078

(22) Filed: Aug. 20, 2001

(65) Prior Publication Data

US 2002/0027063 A1 Mar. 7, 2002

Related U.S. Application Data

(60) Provisional application No. 60/228,223, filed on Aug. 25, 2000.

(51) Int. Cl.[7] ..... H01H 3/16

(52) U.S. Cl. ..... 200/61.45 R; 200/61.52; 200/277; 73/514

(58) Field of Search ..... 200/61.45 R, 61.46, 200/61.52, 61.83, 277, DIG. 18; 73/514

(56) References Cited

U.S. PATENT DOCUMENTS 2,384,652 A * 7/1945 Smith
3,247,340 A 4/1966 Kitzmann
3,311,717 A 3/1967 Lace
3,520,200 A 7/1970 Rodgers
3,611,345 A 10/1971 Pintell
3,963,885 A 6/1976 Brien
3,996,440 A * 12/1976 Niconienko ..... 200/155
4,318,245 A 3/1982 Stowell et al.
4,496,836 A 1/1985 Mikesell
4,503,299 A 3/1985 Henrard et al.
4,751,353 A 6/1988 Stephens
4,766,275 A 8/1988 Hemmann et al.
5,458,524 A 10/1995 Lucas
5,808,254 A 9/1998 Wu
6,149,490 A 11/2000 Hampton et al.
6,193,580 B1 2/2001 Albert et al.

* cited by examiner

*Primary Examiner*—Elvin Enad
*Assistant Examiner*—K. Lee
(74) *Attorney, Agent, or Firm*—Kolisch Hartwell, P.C.

(57) ABSTRACT

According to an embodiment of the invention, a sensor includes a housing with an annular track; a cylindrical contact within the annular track, the cylindrical contact being appropriately sized to allow movement within the annular track; and a plate coupled with the housing, the plate including one or more pairs of electrical contacts situated substantially adjacent to the annular track.

43 Claims, 5 Drawing Sheets

POSITION/MOTION SENSOR

CROSS-REFERENCE TO RELATED APPLICATIONS

This application claims priority under 35 U.S.C. § 119 to provisional application Ser. No. 60/228,223, which was filed on Aug. 25, 2000. The disclosure of that application is hereby incorporated by reference.

FIELD OF THE INVENTION

The present invention relates to position and motion sensors and, more particularly, to position and/or motion sensors that may be employed in electronically controlled toys.

BACKGROUND OF THE INVENTION

Various position sensors and devices that sense motion, which may be employed in an electronically controlled doll or toy, are known. It is common for position/motion sensors to employ spatially distributed electrical contacts, such as on the interior of a spherical or other spatial cavity. In such position/motion sensors, a freely movable contact is typically employed that moves about the cavity when the sensor is moved. Examples of various position and motion sensors are found in U.S. Pat. Nos. 3,611,345, 4,496,836, 4,503,299, 4,751,353 and 4,766,275, the disclosures of which are herein incorporated by reference.

SUMMARY OF THE INVENTION

The present invention includes a position/motion sensor, such as for use in an electronically controlled toy. The sensor has a housing that defines, in part, an annular track. A cylindrical contact roller is contained within the annular track. The roller indicates motion, or relative position, by electrically coupling electrical contact strips arranged adjacent to the annular track. The contact strips are typically included in a plate that is coupled with the housing. A circuit board, or boards, is also typically coupled with the plate and may transmit electrical signals to and from the contact strips to indicate motion or relative position of the sensor and, in turn, a toy in which such a sensor is employed. In two of the depicted embodiments, a position/motion sensor is included in a doll and a toy vehicle.

The advantages of the present invention will be understood more readily after a consideration of the drawings and the Detailed Description.

DETAILED DESCRIPTION AND BEST MODE OF THE INVENTION

Figures 1, 2:
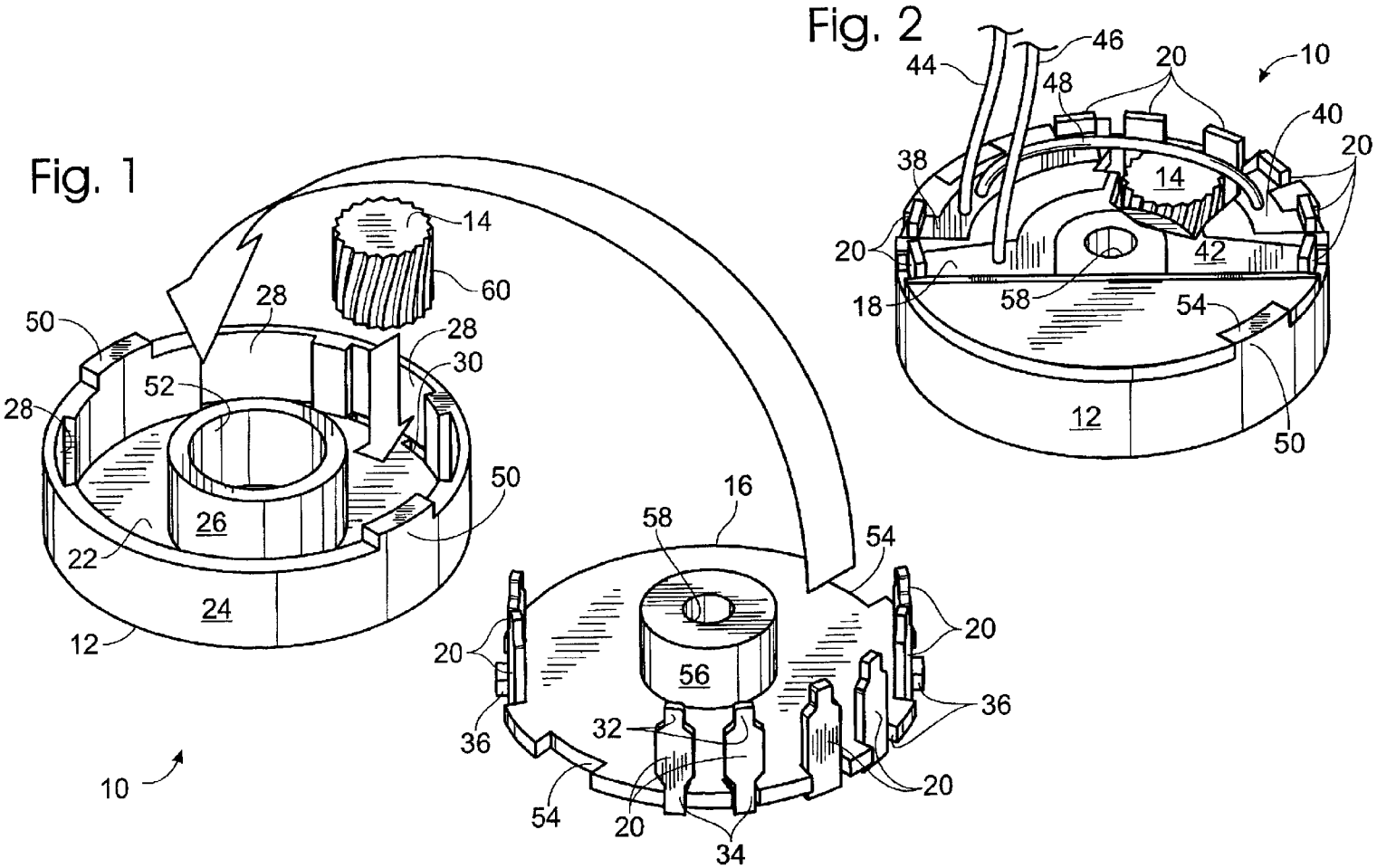
FIG. 1 is a drawing illustrating an exploded view of a position/motion sensor according to the present invention.
FIG. 2 is a drawing illustrating an isometric, partially sectioned, assembled view of the sensor illustrated in FIG. 1.

Referring initially to FIGS. 1 and 2, an embodiment of a position/motion sensor is indicated at 10. Sensor 10 includes a housing 12, a cylindrical contact roller 14 that freely moves within housing 12 and a plate 16 that keeps roller 14 from falling out of housing 12. Sensor 10 also includes a circuit board 18 that may be coupled with plate 16. Pairs of contact strips 20 may be included with circuit board 18 and extend into housing 12 along an annular track 22, and roller 14 rolls within track 22 to make contact with various pairs of strips 20.

Annular track 22 preferably is bounded by an outer wall 24 and an inner wall 26, which may be formed as part of housing 12. Annular track 22 also may include one or more recesses 28 formed in outer wall 24, and one or more pairs of slots 30 formed in housing 12, each associated with a corresponding pair of contact strips 20. More particularly, a tab 32 may be formed as part of contact strips 20, and each tab 32 extends into a corresponding slot 30 to hold the distal end of each strip 30 in a fixed position relative to annular track 22 and the corresponding recess 28.

A proximal end of each contact strip 20 is attached to plate 16. For example, each contact strip 20 may include a tapered portion 34, and plate 16 may include a corresponding cutout 36 in which tapered portion 34 is held. Alternatively, non-tapered contact strips 20 may be used. Preferably, contact strips 20 are held in place by being soldered to a corresponding circuit board trace 38, 40 or 42.

Contact strips 20 may be coupled electrically with an electronic device (not shown) via common wires 44 and 46, and jumper wire 48. More specifically, one contact strip 20 of each pair is electrically coupled with common wire 44 via traces 38 and 40; and jumper wire 48. Likewise, a second contact strip 20 of each pair is electrically coupled with common wire 46 via trace 42.

Roller 14 preferably rolls freely within housing 12 along annular track 22, to complete various electrical circuits in particular positions within annular track 22 by electrically coupling pairs of contact strips 20. Only a single digital output is possible with the embodiment shown in FIGS. 1 and 2, because pairs of contact strips 20 are electrically coupled to common wires 44 and 46. This embodiment may be used to sense motion as completion of an electric circuit by roller 14, but it does not provide any output corresponding to the location of roller 14 within housing 12 other than an indication that roller 14 is in contact with one pair of contact strips 20.

Preferably, housing 12 and plate 16 include features that are shaped to cooperate and ensure proper alignment of those components as well as the alignment of contact strips 20 along annular track 22. For example, housing 12 may define one or more protuberances 50 and a receptacle 52, which may mate, respectively, with notches 54 and post 56 included in plate 16. The portion of plate 16 that defines post 56 may also define a mounting hole 58. Mounting hole 58 may be used to couple sensor 10 with an electronically controlled toy, as will be discussed below.

One final detail to be discussed with respect to FIGS. 1 and 2 is found on the surface of roller 14, in the form of helical grooves 60. Grooves 60 preferably include associated ridges that may improve the electrical connection that roller 14 makes with contact strips 20 as compared to a roller having a smooth surface. Therefore, grooves 60 may improve the overall performance of sensor 10.

Figure 3:
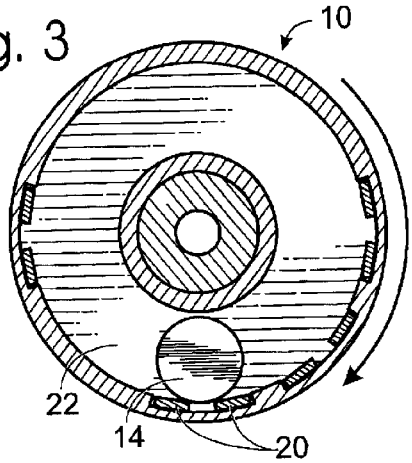
FIGS. 3–5 are drawings illustrating the movement of a cylindrical contact within the sensor depicted in FIGS. 1 and 2 as the sensor is rotated.
Figure 4:
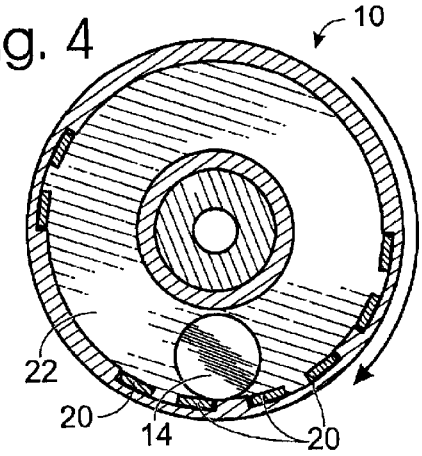
Figure 5:
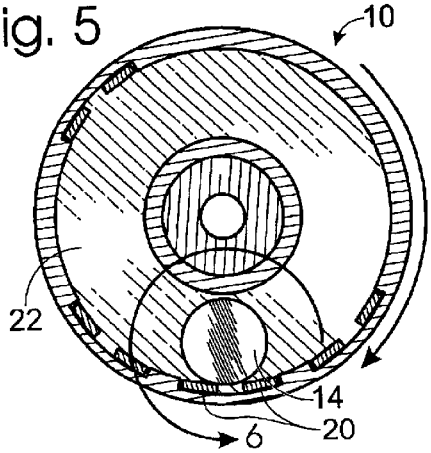

Referring now to FIGS. 3–5, travel of cylindrical roller 14 along annular track 22 as sensor 10 is rotated is depicted. It should be noted that sensor 10 would typically be oriented such that gravitational forces act on roller 14 to move it within annular track 22. For example, roller 14 is shown in FIG. 3 at the lowermost portion of housing 12, where it would fall under the forces of gravity.

FIG. 4 depicts sensor 10 rotated clockwise from the position in FIG. 3. Roller 14 rolls along annular track 22 to stay near the lowermost portion of housing 12, to a position between a first pair and a second pair of contact strips 20. FIG. 5 depicts sensor 10 rotated further clockwise from the position in FIG. 4, in which roller 14 has rolled to electrically couple the second pair of contact strips 20.

Figure 6:
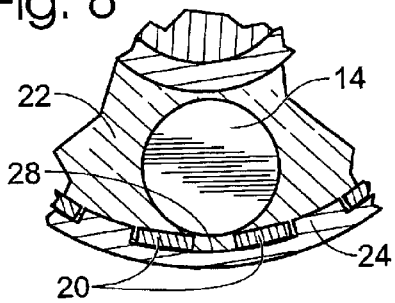
FIGS. 6–9 are sectional drawings of the sensor depicted in FIGS. 1 and 2 illustrating various electrical contact strip configurations.

Various configurations for contact strips 20 may be employed with position/motion sensors according to the invention. For example, FIG. 6 shows in detail a pair of contact strips 20 within recess 28, as has been previously discussed. Such a configuration results in the surfaces of contact strips 20 facing annular track 22 being substantially flush with the non-recessed portions of outer wall 24. In such a situation, roller 14 may move within annular track 22 with relatively low mechanical resistance.

Figure 7:
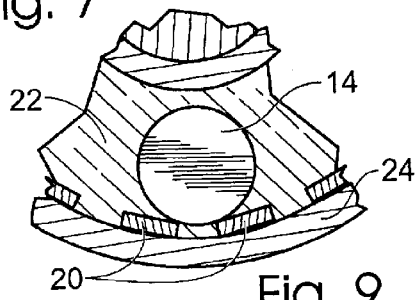

One alternative contact configuration is shown in FIG. 7, in which outer wall 24 has no recesses. For this configuration, contact strips 20 are positioned inside outer wall 24, and some measure of mechanical resistance will be affected by contact strips 20 as roller 14 moves within annular track 22. This mechanical resistance may influence the amount of angular rotation employed to electrically couple the pairs of contact strips 20 via roller 14 in such embodiments. The angular dwell of cylindrical contact 14 within such pairs may also be affected by such a configuration. In this context, angular dwell may be defined as the angular rotation employed from the point where roller 14 electrically couples a pair of contact strips 20, until the point roller 14 electrically decouples from that pair.

Figure 8:
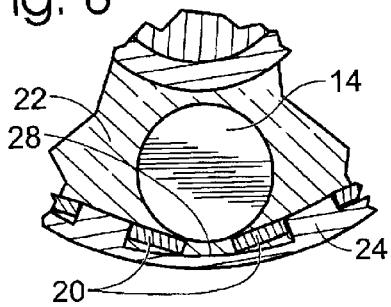
Figure 9:
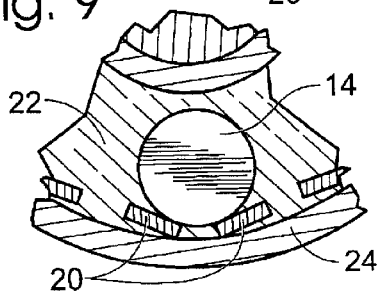

Another alternative contact configuration is shown in FIGS. 8 and 9, in which the pairs of contact strips 20 are sloped relative to one another. Each pair of contact strips 20 in such an embodiment may form a 'v' shape. Such an orientation may affect the angular dwell of roller 14 within such a pair. Typically, angular dwell would increase relative to non-sloped contact strips, as sloped contact strips 20 would cradle roller 14 when electrically coupling such a pair. This cradling may, in turn, increase the angular rotation, e.g. angular dwell, employed to electrically decouple roller 14 from a sloped pair of contact strips 20.

Figure 10:
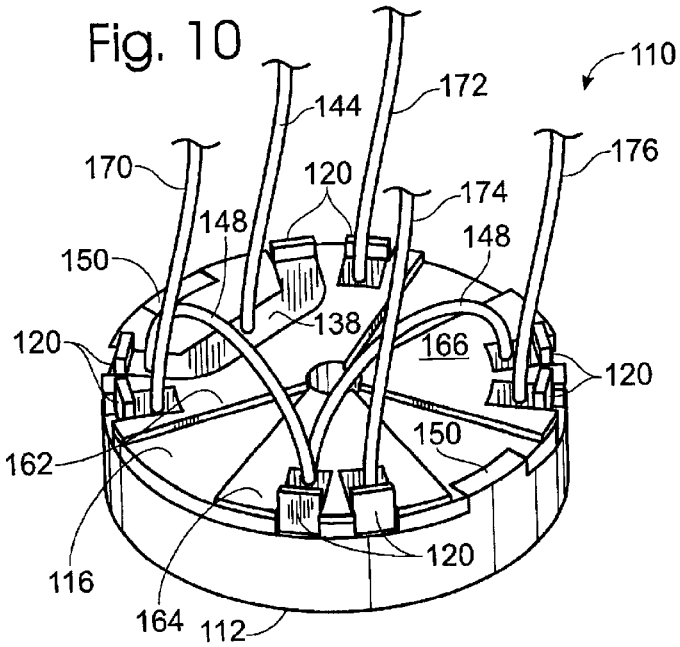
FIG. 10 is a drawing illustrating an isometric view of an alternative position/motion sensor according to the present invention.
Figure 11:
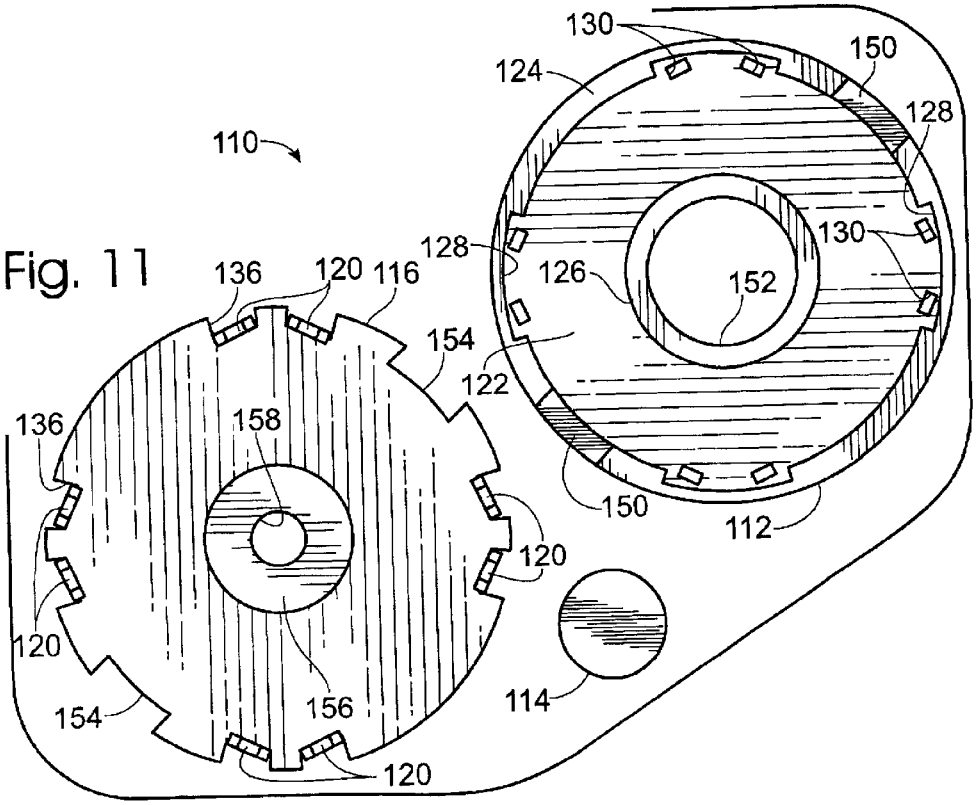
FIG. 11 is a drawing illustrating a top-side, exploded view of a housing, plate and contact of the sensor illustrated in FIG. 10.

Referring now to FIGS. 10 and 11, an alternative embodiment of a position/motion sensor is indicated at 110. Sensor 110 includes basic components that are similar to those discussed with respect to sensor 10. For example, sensor 110 includes housing 112, cylindrical contact roller 114 and plate 116, where roller 114 is shown outside housing 112.

It is noted that the 100-series reference numbers for the elements numbered 112–158 of sensor 110 correspond to the reference numbers 12–58 of sensor 10 for analogous features. For example, housing 112 corresponds with housing 12. These features will not be described in detail again with respect to sensor 110. Furthermore, any of the configurations for contact strips 20 shown in the drawings may be used for this and other embodiments of the invented position/motion sensor.

One aspect of sensor 110 that distinguishes it from sensor 10 is the use of multiple circuit boards 162, 164 and 166 that may be coupled with plate 116. The use of multiple circuit boards may reduce cost as the total amount of material used may be reduced as opposed to using a single circuit board. Likewise, the use of multiple circuit boards may reduce the need for more than one layer of circuit boards traces, which may also reduce overall cost.

Another aspect of interest for sensor 110 is that one contact strip 120 of each pair of contact strips 120 is electrically coupled with an individual wire such as one of wires 170, 172, 174 or 176, and is not electrically coupled with contact strips 120 of any other pair of contact strips 120. This allows this embodiment be used to sense position, and not just motion, because roller 114 may complete one of a separate electrical circuit via one of individual wires 170–176 along with common wire 144. Thus, embodiment 110 may provide four different digital output signals corresponding to the location of roller 114 within housing 112.

Figure 12:
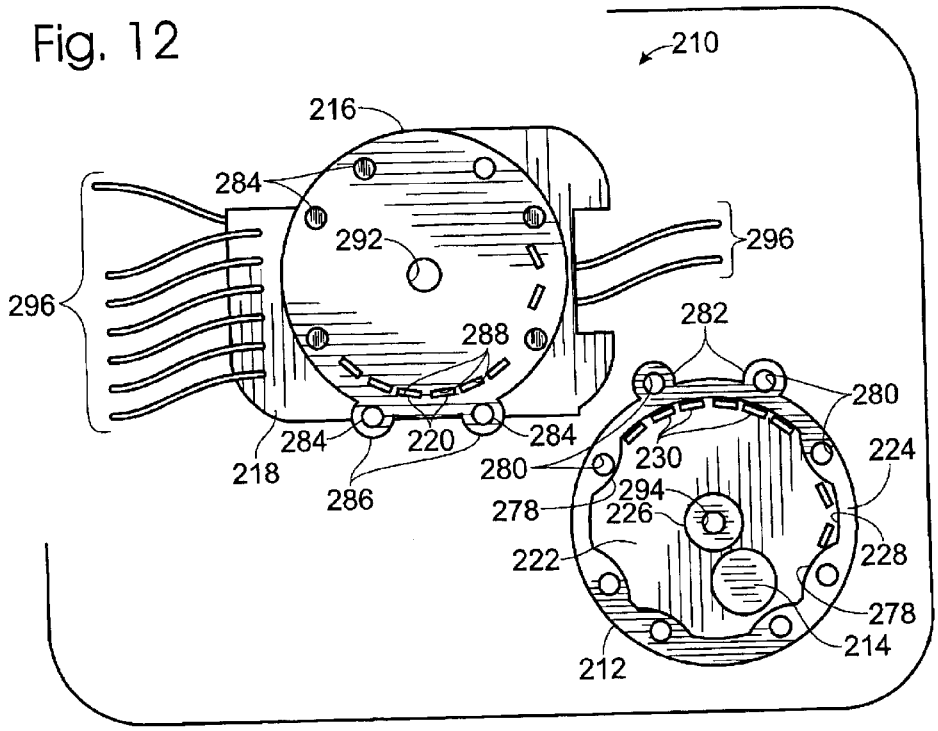
FIG. 12 is a drawing illustrating an isometric assembled view of another alternative embodiment of a position/motion sensor according to the present invention.
Figure 13:
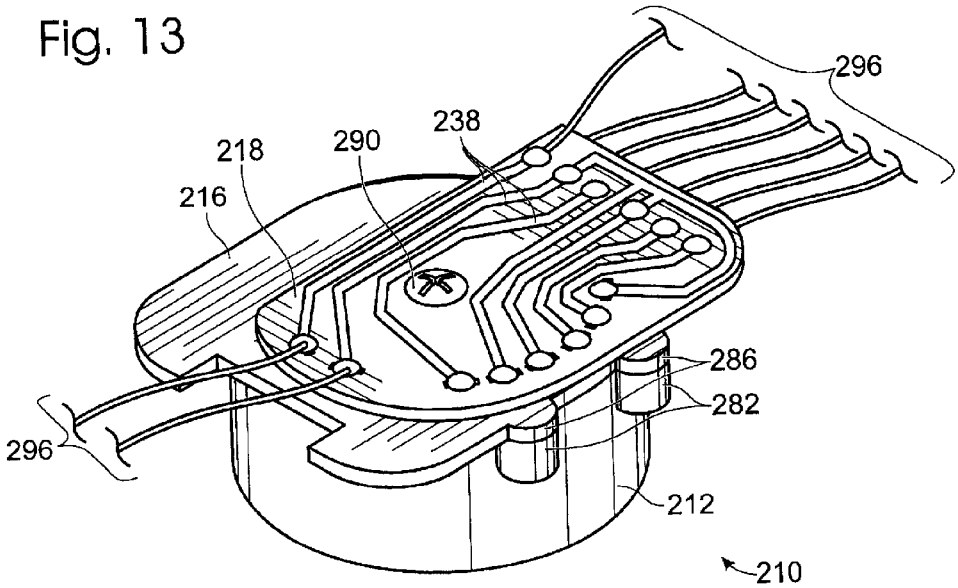
FIG. 13 is a drawing illustrating a top-side, exploded view of a housing, plate and contact of the sensor illustrated in FIG. 12.

Referring now to FIGS. 12 and 13, another alternative position/motion sensor according to the present invention is indicated at 210. Sensor 210 includes basic components that are similar to those discussed with respect to sensors 10 and 110. The 200-series reference numbers used for the elements numbered 212–238 of sensor 210 correspond to the reference numbers 12–38 of sensor 10, and reference numbers 112–138 of sensor 110 for analogous features.

One notable difference of sensor 210 as compared to sensors 10 and 110 is the configuration of outer wall 224. Outer wall 224, while including recesses 228, as previously described, also may include one or more ramps 278. Ramps 278 may reduce the mechanical resistance roller 214 encounters when entering a pair of contact strips 220, as opposed to embodiments not including such ramps. Such a configuration may also affect the angular dwell of sensor 220, as roller 214 may enter a contact strip 220 pair more easily.

Another aspect of sensor 210 that differs from sensors 10 and 110 is the cooperative features for aligning its various components. In this regard, outer wall 224 may include pin-receiving holes 280 formed in outer wall 224 and/or in protrusions 282 included in outer wall 224. Preferably, pin receiving holes 280 mate with pins 284 included on plate 216 and/or protrusions 286 included with lid 216.

With regard to aligning contact strips 220, lid 216 may include slits 288 through which contact strips 220 may be inserted. Slits 288 typically cooperate with slots 230 in housing 212 for aligning contact strips 220 along annular track 222. Once the cooperative features discusses above are mated, housing 212, plate 216 and circuit board 218 may coupled using screw 290. Screw 290 may be inserted through a hole (not shown) in circuit board 218, screw hole 292 in plate 216, and threaded into threaded hole 294, which may be formed along with inner wall 226. Of course, other techniques for coupling the various components of sensor 210 exist.

One final detail to be discussed with respect to FIGS. 12 and 13 is the electrical connections included on circuit board 218. Circuit board 218 may include signal wires 296 and circuit board traces 238. Signal wires 296 and circuit board traces 238 may be configured to connect the contract strips 220 of sensor 210 to an electronic device (not shown) for sensing motion or position, as has been previously described. The present invention is, of course, not limited to the specific connection schemes described and many alternative connection configurations within the scope of the present invention exist.

Figure 15:
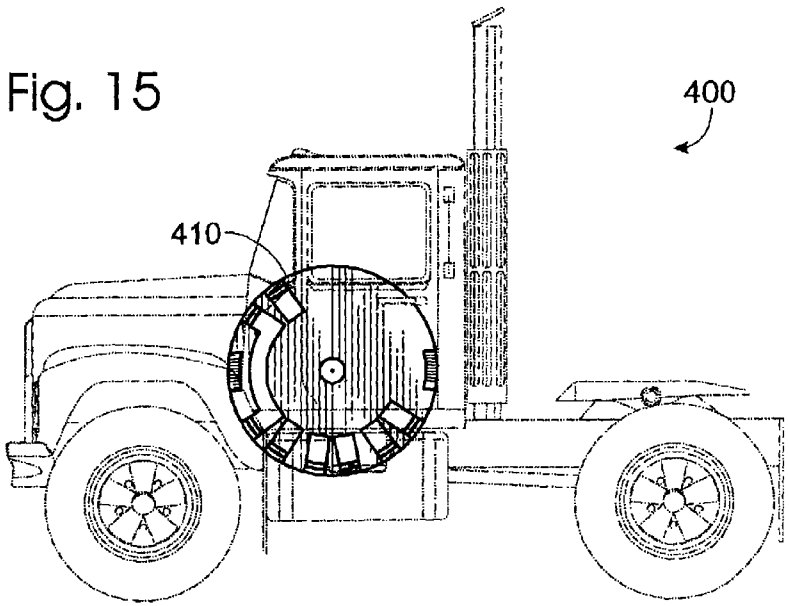
FIG. 15 is a drawing illustrating an embodiment of a toy vehicle according to the present invention.
Figure 14:
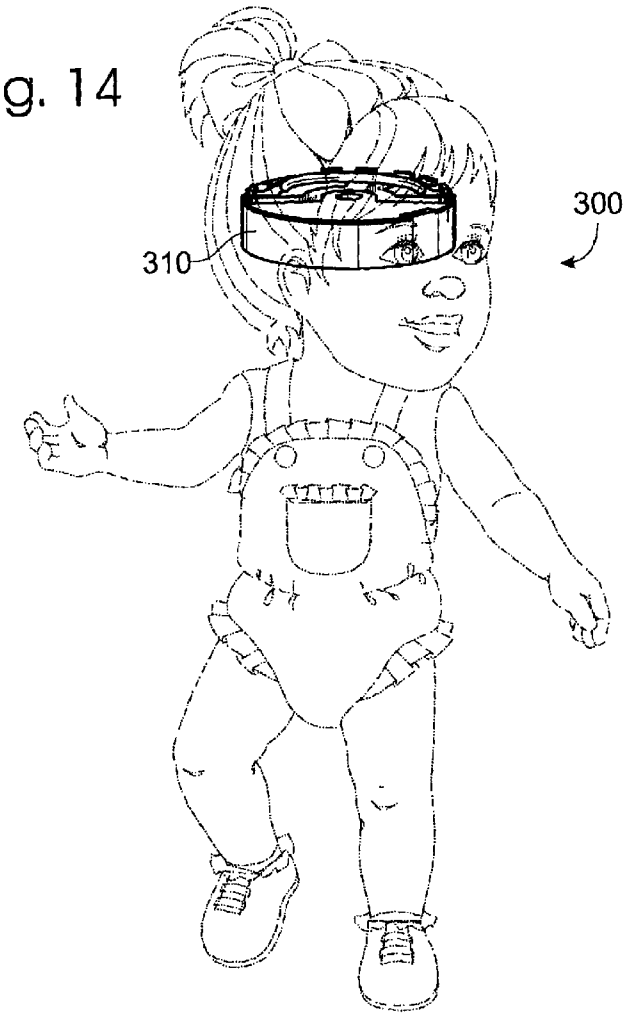
FIG. 14 is a drawing illustrating an embodiment of a doll according to the present invention.

Referring now to FIGS. 14 and 15, two embodiments of toys according to the present invention are depicted. In FIG. 14, a doll according to the present invention is indicated at 300. Doll 300 includes position/motion sensor 310, which may be similar to those embodiments previously described, though the invention is not so limited. Doll 300 may employ sensor 310 to electronically control various functions, such as, for example, voice/sound generation or movement. Of course, other features of the doll may be affected by an indication of motion or relative position as a result of electrical signals conveyed to and from sensor 310.

Referring to FIG. 15, a toy vehicle according to the present invention is indicated at 400. Vehicle 400 includes position/motion sensor 410. As with doll 300, sensor 410 may be used to electronically control various functions of vehicle 400. Such functions may include engine sounds, lights, or a drive mechanism, though the invention is not limited to controlling these functions.

It is believed that the disclosure set forth above may encompass multiple distinct inventions with independent utility. While each of these inventions has been disclosed in its preferred form, the specific embodiments thereof as disclosed and illustrated herein are not to be considered in a limiting sense as numerous variations are possible. The subject matter of the inventions includes all novel and non-obvious combinations and subcombinations of the various elements, features, functions and/or properties disclosed herein. Similarly, where the claims recite "a" or "a first" element or the equivalent thereof, such claims should be understood to include incorporation of one or more such elements, neither requiring nor excluding two or more such elements.

It is believed that the following claims particularly point out certain combinations and subcombinations that are directed to one of the disclosed inventions and are novel and non-obvious. Inventions embodied in other combinations and subcombinations of features, functions, elements and/or properties may be claimed through amendment of the present claims or presentation of new claims in this or a related application. Such amended or new claims, whether they are directed to a different invention or directed to the same invention, whether different, broader, narrower or equal in scope to the original claims, are also regarded as included within the subject matter of the inventions of the present disclosure.

I claim:

1. A sensor comprising:

a housing having an annular track disposed substantially therein, wherein the housing includes at least one pair of electrical contacts being situated substantially adjacent to the annular track; and a substantially cylindrical contact disposed and freely movable within the annular track, the substantially cylindrical contact being appropriately sized to allow movement within the annular track.

2. The sensor of claim 1, wherein at least one of movement and a relative position is indicated by the substantially cylindrical contact creating an electrical connection between a one pair of the at least one pair of electrical contacts.

3. A sensor comprising:

a housing having an annular track disposed substantially therein;

a substantially cylindrical contact disposed within the annular track, the substantially cylindrical contact being appropriately sized to allow movement within the annular track; and a plate coupled with the housing, the plate comprising at least one pair of electrical contacts being situated substantially adjacent to the annular track, wherein the substantially cylindrical contact includes helical grooves and associated ridges disposed on an exterior surface.

4. The sensor of claim 3, wherein an electrical connection between the at least one pair of contacts is accomplished, at least in part, via points of the associated ridges being electrically coupled with a one pair of the at least one pair of electrical contacts.

5. The sensor of claim 3, further comprising at least one notch and at least one corresponding protuberance for aligning the plate with the housing.

6. The sensor of claim 5, wherein the plate includes the at least one notch and the housing includes the at least one protuberance, the at least one notch and the at least one protuberance being formed, respectively, on outer radial portions of the plate and housing.

7. The sensor of claim 3, wherein the housing includes one or more pin receiving holes and the plate includes one or more corresponding pins for aligning the plate with the housing.

8. The sensor of claim 7, wherein the plate and the housing further include one or more protrusions having, respectively, a pin and pin receiving hole for aligning the plate with the housing.

9. A sensor comprising:

a housing having an annular track disposed substantially therein;

a substantially cylindrical contact disposed within the annular track, the substantially cylindrical contact being appropriately sized to allow movement within the annular track; and a plate coupled with the housing, the plate comprising at least one pair of electrical contacts being situated substantially adjacent to the annular track, wherein the annular track is defined, at least in part, by an outer wall of the housing, an inner wall of the housing, and a face of the plate.

10. The sensor of claim 9, wherein the outer wall includes one or more ramps for reducing a mechanical resistance encountered by the substantially cylindrical contact when entering the at least one pair of electrical contacts.

11. The sensor of claim 9, wherein the inner wall of the housing forms, at least in part, a cylindrical receptacle for accepting a post of the plate, the post having a mounting hole disposed therein.

12. The sensor of claim 11, wherein the housing is coupled with an electronically controlled toy via the mounting hole.

13. The sensor of claim 12, wherein the electronically controlled toy comprises an electronically controlled doll.

14. The sensor of claim 12, wherein the electronically controlled toy comprises an electronically controlled vehicle.

15. The sensor of claim 9, wherein the at least one pair of electrical contacts is disposed radially inward relative to the outer wall so as to affect the angular rotation employed to result in completion of an electrical connection between a one pair of the at least one pair of electrical contacts via the substantially cylindrical contact.

16. The sensor of claim 9, wherein the outer wall of the housing includes at least one recessed portion, the at least one pair of electrical contacts being correspondingly disposed substantially within the at least one recessed portion so as to affect the angular rotation employed to result in completion of an electrical connection between a one pair of the at least one pair of electrical contacts via the substantially cylindrical contact.

17. A sensor comprising:

a housing having an annular track disposed substantially therein;

a substantially cylindrical contact disposed within the annular track, the substantially cylindrical contact being appropriately sized to allow movement within the annular track; and a plate coupled with the housing, the plate comprising at least one pair of electrical contacts being situated substantially adjacent to the annular track, wherein a first contact and a second contact of the at least one pair of electrical contacts are sloped relative to each other so as to cradle the substantially cylindrical contact when the first and second contacts are electrically coupled via the substantially cylindrical contact.

18. The sensor of claim 17, wherein the at least one pair of electrical contacts comprise tabs substantially disposed within corresponding slots in the housing so as to maintain the first and second contacts in a substantially predetermined alignment with the annular track.

19. The sensor of claim 18, wherein the plate further comprises cutouts, corresponding proximal ends of the at least one pair of electrical contacts being disposed within the cutouts so as to align the tabs of the at least one pair of electrical contacts with the corresponding slots in the housing.

20. A sensor comprising:

a plurality of radially dispersed pairs of electrical contacts, the pairs of contacts being substantially adjacent to an annular track, the annular track being defined, at least in part, by a housing, and a plate coupled with at least one circuit board; and a substantially cylindrical contact disposed within the annular track being capable of movement with the annular track;

wherein the plurality of radially dispersed pairs of electrical contacts are coupled with the at least one circuit board, the at least one circuit board having a plurality of electrical conductors to convey electrical signals to and from the plurality of radially dispersed pairs of electrical contacts, the electrical signals resulting, at least in part, from electrically coupling the pairs of radially dispersed electrical contacts via the substantially cylindrical contact.

21. The sensor of claim 20, further comprising a plurality of circuit boards, a respective circuit board of the plurality of circuit boards being associated with each pair of electrical contacts of the plurality of pairs of electrical contacts.

22. The sensor of claim 20, wherein the plurality of radially dispersed pairs of electrical contacts are disposed inward toward a center of the housing relative to an outer wall of the housing.

23. The sensor of claim 20, wherein the plurality of radially dispersed pairs of electrical contacts are sloped relative to one another so as to cradle the substantially cylindrical contact and increase angular dwell of the substantially cylindrical contact within the plurality of radially dispersed pairs of electrical contacts relative to non-relatively sloped contacts.

24. The sensor of claim 20, wherein the plurality of radially dispersed pairs of electrical contacts are disposed outward from a center of the housing relative to an outer wall of the annular track and substantially disposed within corresponding recesses in the outer wall of the housing.

25. The sensor of claim 20, wherein a first contact of each of the plurality of radially dispersed pairs of electrical contacts is electrically coupled with a first electrical conductor and a second contact of each of the plurality of radially dispersed pairs of electrical contacts is electrically coupled with a second electrical conductor via the at least one circuit board.

26. The sensor of claim 20, wherein a first contact of each pair of the plurality of radially dispersed pairs of electrical contacts is electrically coupled with a common electrical conductor and a second contact of each pair of the plurality of radially dispersed pairs of electrical contacts is electrically coupled with a corresponding electrical conductor.

27. The sensor of claim 26, wherein the first and second contacts of each pair of electrical contacts are electrically coupled with, respectively, the common electrical conductor and the corresponding electrical conductors via the at least one circuit board.

28. A sensor comprising:

a housing defining, in part, an annular track, wherein the housing includes one or more pairs of electrical contacts positioned adjacent to the annular track; and a movable cylindrical contact contained within the annular track, wherein movement of the movable cylindrical contact within the annular track is primarily caused by gravitational forces.

29. A sensor comprising:

a housing defining, in part, an annular track;

a movable cylindrical contact contained within the annular track; and a plate coupled with the housing, the plate including one or more pairs of electrical contacts that extend into the housing positioned adjacent to the annular track, wherein the housing includes an inner wall and an outer wall that define, in part, the annular track.

30. The sensor of claim 29, wherein the outer wall includes one or more ramps for reducing the mechanical resistance encountered by the cylindrical contact when entering the one or more pairs of electrical contacts.

31. A sensor comprising:

a housing defining, in part, an annular track;

a movable cylindrical contact contained within the annular track; and a plate coupled with the housing, the plate including one or more pairs of electrical contacts that extend into the housing positioned adjacent to the annular track, wherein the plate includes cutouts for receiving and positioning the one or more pairs of electrical contacts such that, for each contact, a tab formed on the contact is aligned with an associated slot in the housing, the tab being disposed within an associated slot when the plate is coupled with the housing.

32. The sensor of claim 29, wherein the housing includes a protuberance and the plate includes an associated notch for aligning the housing with the plate.

33. The sensor of claim 29, wherein the housing includes one or more pin receiving holes and the plate includes one or more corresponding pins for aligning the plate with the housing.

34. The sensor of claim 33, wherein the plate and the housing further include one or more protrusions having, respectively, a pin and a corresponding pin receiving hole for aligning the plate with the housing.

35. A sensor comprising:

a housing defining, in part, an annular track;

a movable cylindrical contact contained within the annular track; and a plate coupled with the housing, the plate including one or more pairs of electrical contacts that extend into the housing positioned adjacent to the annular track, wherein the plate includes a post defining a mounting hole, the post being appropriately sized so as to insert into a receptacle defined by an inner wall of the housing when the plate is coupled with the housing.

36. The sensor of claim 35, wherein the housing is coupled with an electronically controlled toy via the mounting hole.

37. The sensor of claim 29, further comprising at least one circuit board coupled with the plate, the one or more pairs of electrical contacts being electrically coupled with the at least one circuit board.

38. A sensor comprising:

a housing defining, in part, an annular track;

a movable cylindrical contact contained within the annular track;

a plate coupled with the housing, the plate including one or more pairs of electrical contacts that extend into the housing positioned adjacent to the annular track;

at least one circuit board coupled with the plate, the one or more pairs of electrical contacts being electrically coupled with the at least one circuit board; and a plurality of electrical connectors coupled with the at least one circuit board for communicating electrical signals to and from the one or more pairs of electrical contacts as a result of the cylindrical contact electrically coupling individual pairs of the one or more pairs of electrical contacts.

39. The sensor of claim 38, wherein a first electrical connector is electrically coupled with a first electrical contact of each of the one or more pairs of electrical contacts and a second electrical connector is electrically coupled with a second electrical contact of each of the one or more pairs of electrical contacts.

40. The sensor of claim 38, wherein a first electrical connector is electrically coupled with a first electrical contact of each of the one or more pairs of electrical contacts and individual electrical connectors are electrically coupled with respective second electrical contacts of each of the one or more pairs of electrical contacts.

41. A sensor comprising:

a housing defining, in part, an annular track;

a movable cylindrical contact contained within the annular track; and a plate coupled with the housing, the plate including one or more pairs of electrical contacts that extend into the housing positioned adjacent to the annular track, wherein the one or more pairs of electrical contacts are positioned within one or more recesses formed in an outer wall of the housing.

42. A sensor comprising:

a housing defining, in part, an annular track;

a movable cylindrical contact contained within the annular track; and a plate coupled with the housing, the plate including one or more pairs of electrical contacts that extend into the housing positioned adjacent to the annular track, wherein a first and second contact of each pair of the one or more pairs of electrical contacts are sloped relative to one another so as to cradle the cylindrical contact and increase an angular dwell of the cylindrical contact within each pair as the housing is moved.

43. A sensor comprising:

a housing defining, in part, an annular track;

a movable cylindrical contact contained within the annular track; and a plate coupled with the housing, the plate including one or more pairs of electrical contacts that extend into the housing positioned adjacent to the annular track, wherein the cylindrical contact includes helical grooves formed thereon, the grooves having associated ridges, the points of the ridges resulting in an electrical connection between a first contact and a second contact of each pair of the one or more pairs of electrical contacts when the cylindrical contact is appropriately positioned.

* * * * *